US010407980B2

(12) United States Patent
Hall et al.

(10) Patent No.: US 10,407,980 B2
(45) Date of Patent: Sep. 10, 2019

(54) CORDLESS WINDOW COVERING SYSTEM WITH BEARINGS

(71) Applicants: David R. Hall, Provo, UT (US); Emily Brimhall, Alpine, UT (US); Joe Fox, Spanish Fork, UT (US); Terrece Pearman, Draper, UT (US); Jennifer Stevens, Provo, UT (US)

(72) Inventors: David R. Hall, Provo, UT (US); Emily Brimhall, Alpine, UT (US); Joe Fox, Spanish Fork, UT (US); Terrece Pearman, Draper, UT (US); Jennifer Stevens, Provo, UT (US)

(73) Assignee: Hall Labs LLC, Provo, UT (US)

( * ) Notice: Subject to any disclaimer, the term of this patent is extended or adjusted under 35 U.S.C. 154(b) by 356 days.

(21) Appl. No.: 15/485,933

(22) Filed: Apr. 12, 2017

(65) Prior Publication Data

US 2018/0298681 A1 Oct. 18, 2018

(51) Int. Cl.

| | |
|---|---|
| ***E06B 9/32*** | (2006.01) |
| ***E06B 9/262*** | (2006.01) |
| ***E06B 9/386*** | (2006.01) |
| ***E06B 9/327*** | (2006.01) |
| ***E06B 9/322*** | (2006.01) |
| ***E06B 9/302*** | (2006.01) |

(52) U.S. Cl.

CPC ..... *E06B 9/322* (2013.01); *E06B 9/302* (2013.01); *E06B 9/327* (2013.01); *E06B 9/262* (2013.01); *E06B 9/32* (2013.01); *E06B 9/386* (2013.01); *E06B 2009/3222* (2013.01)

(58) Field of Classification Search

CPC .. E06B 9/322; E06B 2009/3222; E06B 9/386; E06B 9/327; E06B 2009/2646; E06B 9/02; E06B 9/266; E06B 9/368; E06B 9/68; E06B 9/70; E06B 9/72; E06B 9/74; E06B 9/32; E06B 9/262; E06B 2009/285; E06B 9/30; E06B 9/308; E06B 2009/425; E06B 9/50; E06B 9/58; E06B 2009/785

See application file for complete search history.

(56) References Cited

U.S. PATENT DOCUMENTS 2,037,393 A * 4/1936 Roberts ..... E06B 9/308 160/169
4,846,244 A * 7/1989 Rosenfeld ..... E06B 9/0638 160/201
4,852,627 A * 8/1989 Peterson ..... E06B 9/262 160/84.02

(Continued)

*Primary Examiner* — Phi D A

(57) ABSTRACT

We disclose a cordless window covering that may raise, lower, and tilt a plurality of slats without the use of lift cords. The covering may include an external frame with two vertical sides and a headrail. The covering may also include a plurality of slats, each of which may be connected to an adjacent slat by at least one string on each side and the headrail. This may allow the slats to hang freely when lowered. It may also allow all the slats to tilt when only the top slat has been mechanically tilted by a drive belt. The bottom slat may include a bottom bearing connector which may interact with a drive belt such that it may be raised and lowered when the drive belt rotates. Each slat may be connected to a bearing and a bearing connector that may be slidably connected to a guide channel.

20 Claims, 8 Drawing Sheets

(56) References Cited

U.S. PATENT DOCUMENTS

| | | | | |
|---|---|---|---|---|
| 5,083,598 | A * | 1/1992 | Schon | E06B 9/32 160/279 |
| 5,195,569 | A * | 3/1993 | Peterson | E06B 9/327 160/84.06 |
| 2005/0022946 | A1* | 2/2005 | Domel | E06B 9/322 160/168.1 P |
| 2012/0097343 | A1* | 4/2012 | O'Hair | E06B 9/307 160/168.1 R |
| 2016/0024841 | A1* | 1/2016 | Yeh | E06B 9/68 60/527 |
| 2017/0009519 | A1* | 1/2017 | Marocco | E06B 9/44 |
| 2018/0298683 | A1* | 10/2018 | Huang | E06B 9/322 |

* cited by examiner

CORDLESS WINDOW COVERING SYSTEM WITH BEARINGS

BACKGROUND

Field of the Invention

This disclosure relates to window blinds, specifically window blinds which do not use cords to move the slats.

Background of the Invention

Traditional Venetian window blinds operate with a draw cord and lift cords, which raise and lower the blind slats. Many window blinds use ladder cords, which raise, lower, and tilt the slats. Draw cords can be a strangulation hazard as well as detract from the aesthetic appeal of the window blind, so window blinds have been developed that operate without the use of draw cords. Lift cords can also be aesthetically unappealing, but few Venetian blinds have eliminated them. A window blind is needed which does not use any visible cords to raise and lower a window blind.

BRIEF SUMMARY OF THE INVENTION

We disclose a cordless window covering system that may raise, lower, and tilt a plurality of slats without the use of lift cords. The cordless window covering system may include an external frame that includes two vertical sides and a headrail. The vertical sides of the external frame may each include a first rotatable belt which may be attached to a first axial shaft contained within the headrail and third axial shaft at the bottom of the external frame. A first motor may also be included in the headrail and may rotate the first axial shaft such that the first rotatable belt may also rotate. In some embodiments, the first axial shaft and first motor may be contained within a bottom rail. In such embodiments, the third axial shaft may be contained within the headrail. In some embodiments of the invention, the first motor may be powered by a battery and actuated by a controller. The headrail may also contain a second axial shaft, which may be attached to a second motor. The second motor may reversibly rotate the second axial shaft across a 180° angle.

The cordless window covering system may also include a plurality of slats, each of which may include pegs extending from each of a first and a second lateral side of each slat. The peg may connect fixedly to an inner race of one of a plurality of bearings. Each of the plurality of slats may also be connected to at least one string. The at least one string may be connected to each slat approximately along the first and second lateral sides of each slat and may attach each of the plurality of slats to an adjacent slat. The at least string may be attached at the top to the headrail such that the plurality of slats may hang from the headrail.

Each of the plurality of bearings may also include an outer race. The outer race may be fixedly attached to a bearing connector such that the outer race may remain stationary with respect to the bearing connector and the inner race. Each bearing connector may be attached to one of the plurality of slats and may freely rotate.

The external frame may also include a guide shaft on each of the two vertical sides. The guide shaft may be vertically oriented. The guide shaft may slidably guide the bearing connectors. This may allow each of the bearing connectors to raise and lower each of the plurality of slats in a vertical direction. In some embodiments of the disclosed cordless window covering system, a bottom bearing connector may interface with the first rotatable belt such that the bottom bearing connector may raise or lower as the first rotatable belt rotates. This may allow the bottom bearing connector to raise the slat to which it is attached, and consequently, the slats above the slat attached to the bottom bearing connector may also be raised.

The cordless window covering system may also include a top bearing that may have an inner bearing which may interface with a second rotatable belt at the bottom of the second rotatable belt. The second rotatable belt may interface at the top with a second axial shaft which may be contained in the headrail. This may allow the second axial shaft to rotate the inner race of the top bearing, and thus a slat to which the top bearing is attached, up to 180°. Since the slat to which the top bearing is attached may be attached by the at least one string on both the first and second lateral sides, as the axial shaft rotates the top bearing, each of the plurality of slats may also rotate.

DETAILED DESCRIPTION OF THE INVENTION

Definitions

Figure 1A:
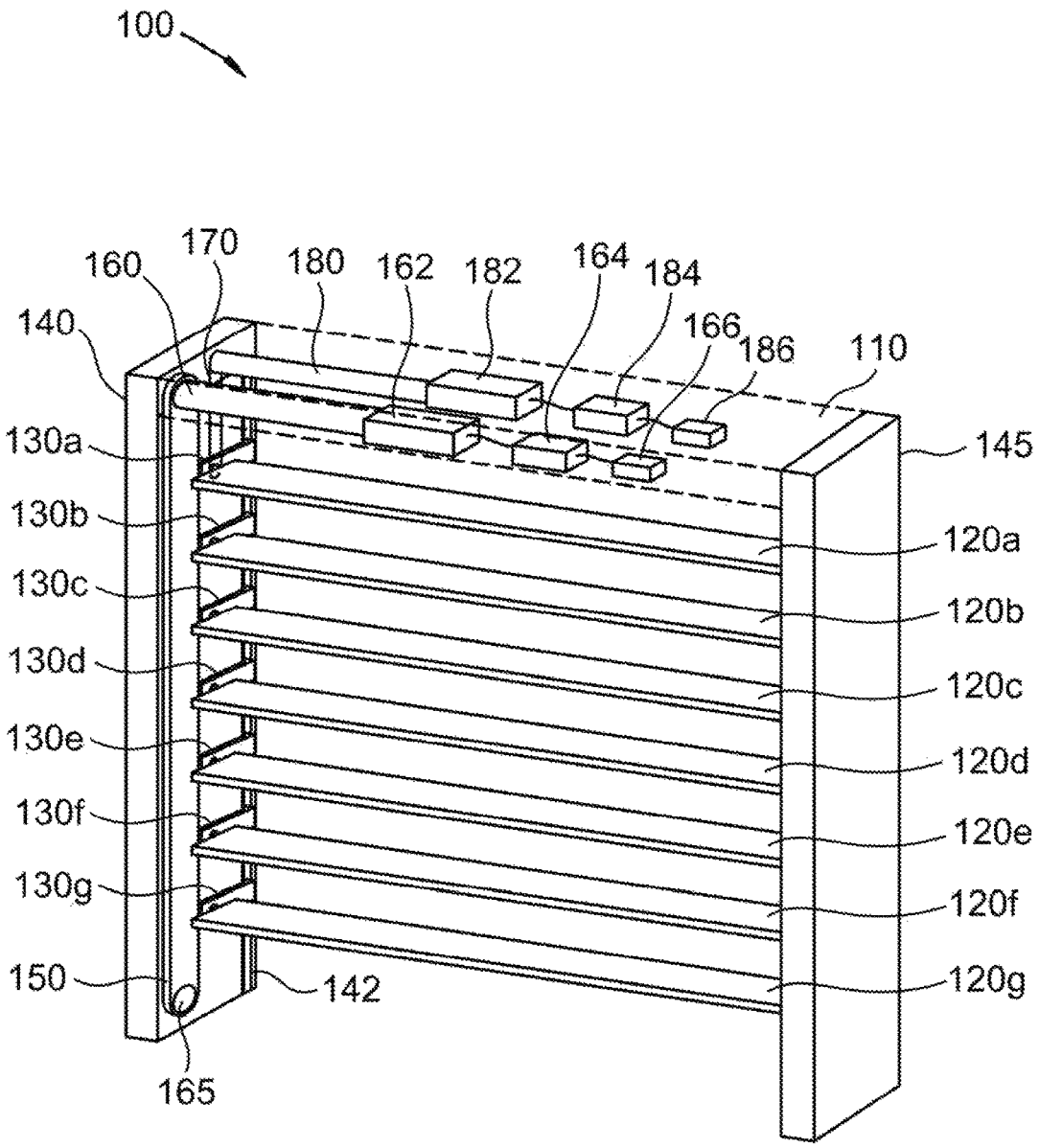
FIG. 1A illustrates an overall perspective view of an embodiment of a cordless window covering system according to the disclosure.

Window blind, as used herein, means a blind that covers an opening in a building, including a window or door.

While this invention is susceptible of embodiment in many different forms, there are shown in the drawings, which will herein be described in detail, several specific embodiments with the understanding that the present disclosure is to be considered as an exemplification of the principals of the invention and is not intended to limit the invention to the illustrated embodiments.

We disclose a cordless window covering system that may raise, lower, and tilt a plurality of slats without the use of lift cords. The cordless window covering system may include a frame which may be two vertical sides attached to a headrail. Each of the two vertical sides may also include a first drive belt which may be attached at the top to a first horizontal shaft. The first drive belt may be attached at the bottom to a third horizontal shaft, which in some embodiments may be a short horizontal shaft. The first horizontal shaft may be contained within the headrail and may be attached to a first motor. In some embodiments of the invention, the first motor may be powered by a first battery. Additionally, in some embodiments of the invention, the first battery may be connected to a first motor controller. The first motor controller may allow the first horizontal shaft to be actuated remotely. The first motor may fully and reversibly rotate the first horizontal shaft. In some embodiments, the first horizontal shaft may be contained within a bottom rail. In such embodiments, the bottom rail may also contain the first motor, first battery, and first motor controller. In such embodiments, the first horizontal belt may be attached at the bottom to the first horizontal shaft and at the top to the third horizontal shaft, the latter of which may be contained in the headrail.

The headrail may also contain a second horizontal shaft, which may be attached to a second motor. The second motor may reversibly rotate the second horizontal shaft across a 180° angle. In some embodiments of the invention, the second motor may be powered by the first battery and actuated by the first motor controller. Alternatively, a second battery may power the second motor. The second battery may also be connected to a second motor controller.

The cordless window covering system may also include a plurality of slats, each of which may include a first and a second peg on a first and a second lateral side of each slat, respectively. The pegs may extend laterally from the first and second lateral sides of each slat. The first and second pegs may each attach to the center of an inner race of one of a plurality of bearings. The first and second lateral sides of each of the plurality of slats may also each be attached to at least one string. The at least one string may attach each of the plurality of slats to an adjacent slat. The at least string on or near the first and second lateral side of each slat may be attached at the top to the headrail such that the plurality of slats may hang from the headrail.

Each of the plurality of bearings may also include an outer race. The outer race may be fixedly attached to a bearing connector such that the outer race may remain stationary with respect to the bearing connector and the inner race. Each bearing connector may be attached to one of the plurality of slats and may freely rotate. In some embodiments, each of the plurality of bearings may be a ball bearing. In other embodiments, each of the plurality of slats may be a needle bearing. Other embodiments may include other types of bearings known in the art.

The frame may also include a guide channel on each of the two vertical sides. The guide channel may be vertically oriented. The guide channel may slidably guide the bearing connectors. This may allow each of the bearing connectors to raise and lower each of the plurality of slats in a vertical direction.

In some embodiments of the disclosed invention, a bottom bearing connector may interface with the first drive belt such that the bottom bearing connector may raise or lower as the first drive belt rotates. This may allow the bottom bearing connector to raise the slat to which it is attached. In some embodiments, the bottom bearing connector may interface with one or more of a plurality of grooves within the first drive belt. In other embodiments, the bottom bearing connector may be attached to the first drive belt. The bottom bearing connector may be attached to the first drive belt by means that include adhesion, hooks, screws, or any other connection mechanism known in the art.

The cordless window covering system may also include a top bearing that may have an inner bearing which may interface with a second drive belt at the bottom of the second drive belt. The second rotatable belt may interface at the top with the second horizontal shaft. This may allow the second horizontal shaft to rotate the inner race of the top bearing, and thus a slat to which the top bearing is attached, up to 180°. Since the slat to which the top bearing is attached may be attached by at least one string on both the first and second lateral sides, as the horizontal shaft rotates the top bearing, each of the plurality of slats may also rotate.

In order to facilitate controlled tilting of the slats, each of the lateral sides of each slat may be attached to two strings. Alternatively, each slat may be attached to at least four strings, where two strings are attached to each of the two lateral sides of each slat and also attached to the adjacent slat above it. In this embodiment, the four strings of a top slat may be attached to the headrail.

Referring now to the drawings, FIG. 1A illustrates window blind 100 which is an embodiment of the disclosed cordless window covering system. Window blind 100 includes headrail 110 and a frame which includes vertical sides 140 and 145. In this embodiment, headrail 110 includes first horizontal shaft 160. First horizontal shaft 160 may rotate causing first drive belt 150 to rotate around third horizontal shaft 165 at the opposite end of first drive belt 150. First horizontal shaft 160 may be actuated by motor 162, which may be connected to battery 164. Battery 164 may power motor 162 when motor controller 166 receives a signal from a user to remotely operate window blind 100. Headrail 110 also includes second horizontal shaft 180, which may rotate second drive belt 170. Second horizontal shaft 180 may be actuated by motor 182, which may be connected to and powered by battery 184. Battery 184 may power motor 182 when controller 186 receives a signal from a user to remotely operate window blind 100. In some embodiments, a single battery and motor controller may actuate both motor 162 and motor 182. Motor controllers 166 and 186 may receive remote signals from a Bluetooth device or any other transmitting device as may be known in the art. Window blind 100 also includes slats 120*a*-120*g*. Slats 120*a*-120*g* may each be attached to bearing connectors 130*a*-130*g*, respectively. Bearing connectors 130*a*-130*g* may each be slidably to guide channel 142. The drive belt, bearing connectors, and horizontal shaft of vertical side 145 are omitted in this figure for clarity.

Figure 1B:
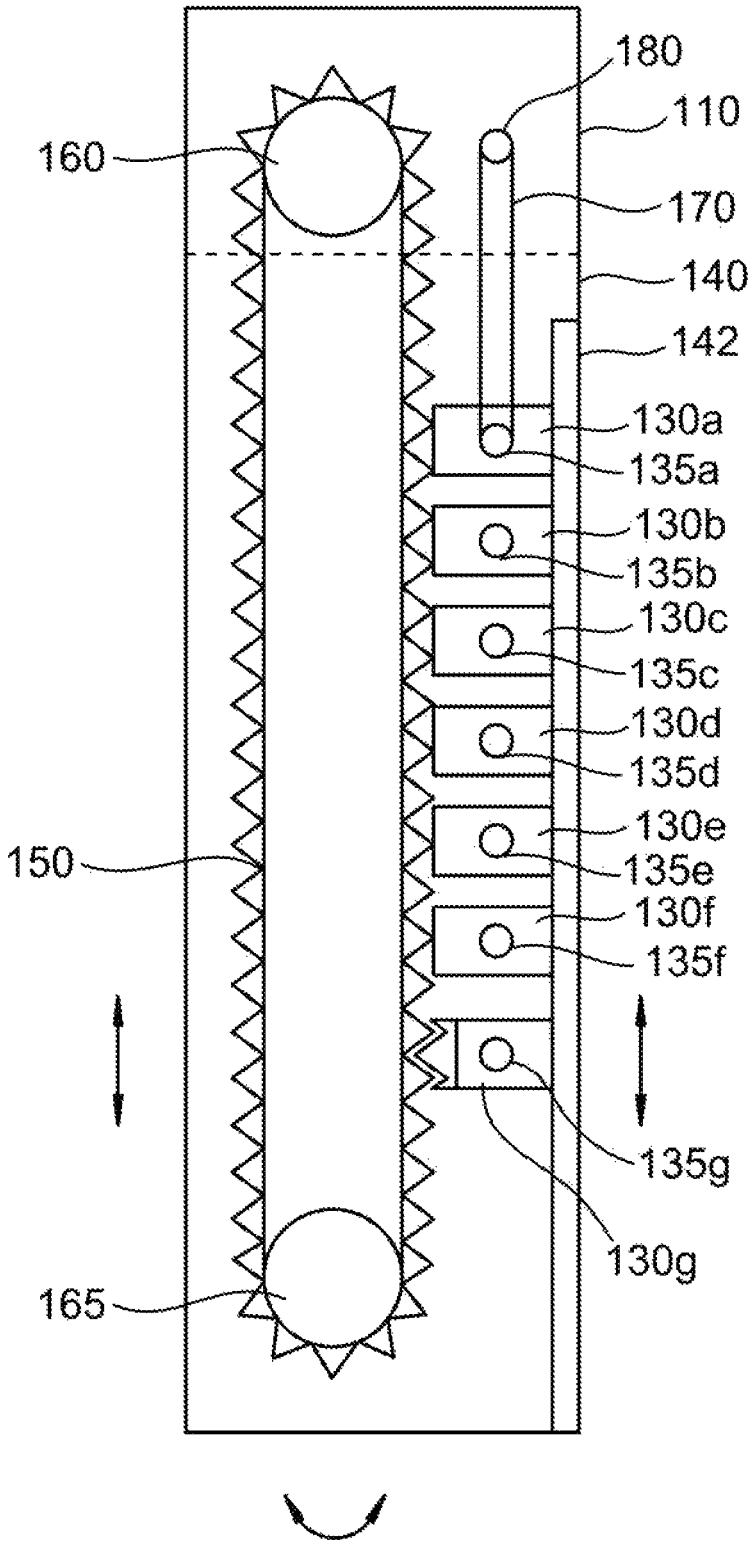
FIG. 1B shows a close-up view of one side of the frame shown in FIG. 1A.

FIG. 1B illustrates vertical side 140 from the frame of window blind 100 shown in FIG. 1A. Headrail 110 is shown encompassing first horizontal shaft 160 and second horizontal shaft 180. Bearing connectors 130*a*-130*g* are shown with bearings 135*a*-135*g* included. Bearing connectors 130*a*-130*g* may each be slidaby connected to guide channel 142, as shown. In this figure, second drive belt 170 is shown interfacing with top bearing 135*a* and horizontal shaft 180. This may allow the rotation of second horizontal shaft 180 to rotate top bearing 135*a*. Bottom bearing connector 130*g* is also shown, and in this embodiment, is interacting with grooves in first drive belt 150.

Figure 1C:
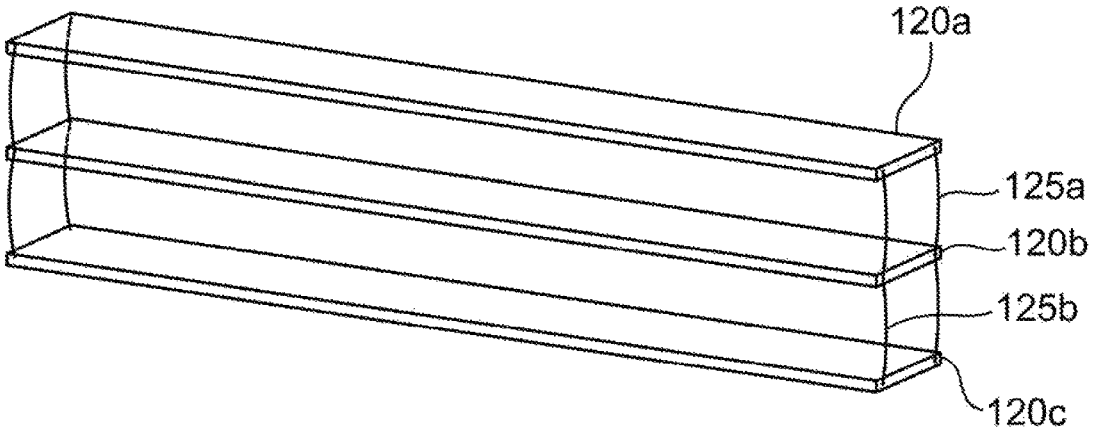
FIG. 1C shows a close-up perspective view of three of the slats of a cordless window covering system according to the disclosure.

FIG. 1C shows the top three slats of window blind 100 as shown in FIG. 1A, with the other slats omitted for clarity. Slats 120*a*-120*c* are attached to each other by use of strings 125*a* and 125*b*. Each of the strings is attached to a lateral side of each of the slats. This may allow the slats to hang and to rotate together as the top slat is rotated as described in this application.

Figure 2:
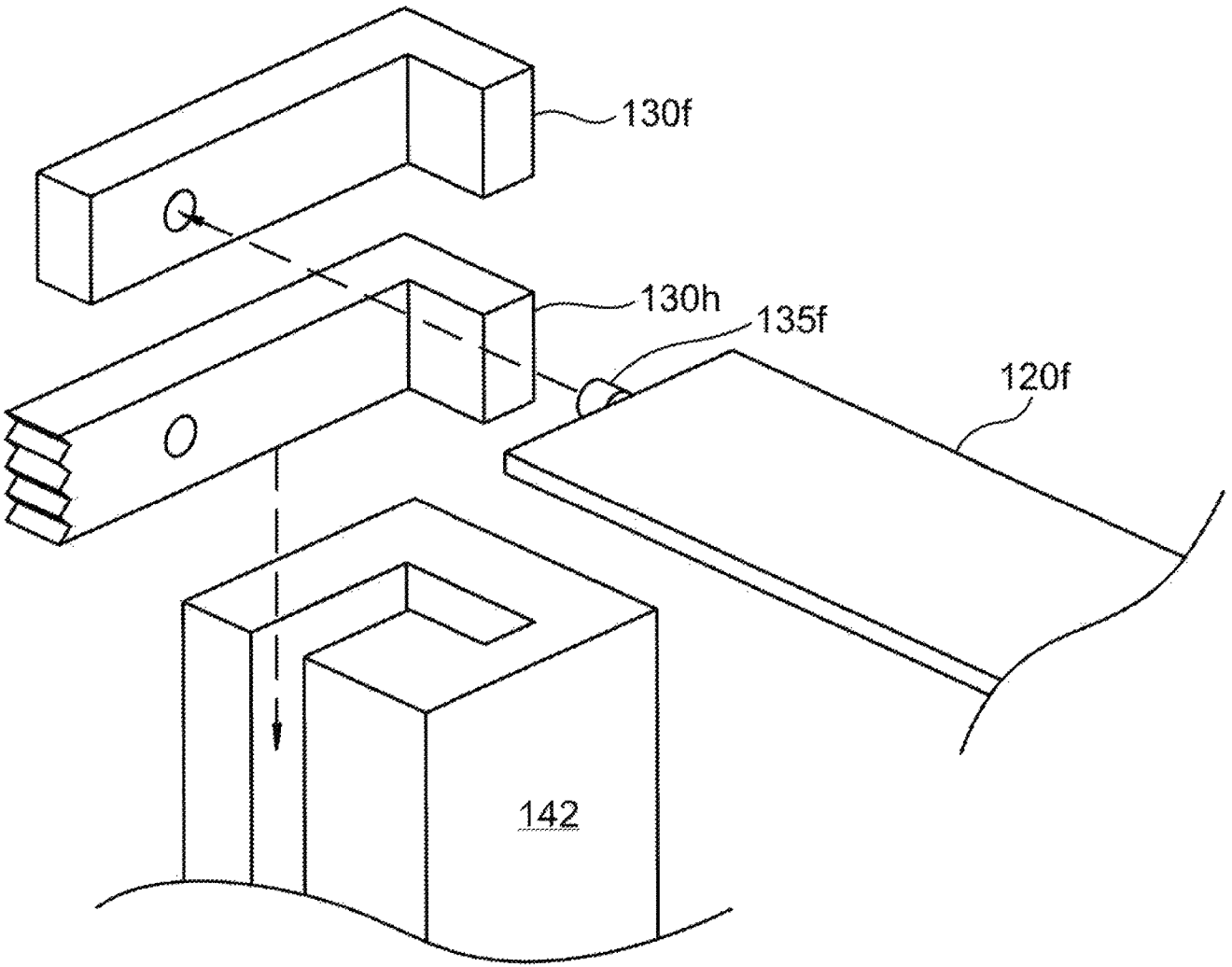
FIG. 2 shows a close-up view of an embodiment the bottom two bearing connectors, a slat, and an embodiment of the guide channel.

FIG. 2 illustrates a close-up view of one potential embodiment of the bearing connectors and guide channel. In this embodiment, bearing connectors 130*f* and 130*g* are shown as they would slidably interface with guide channel 142. Slat 120*f* is also shown with bearing 135*f*. Bearing 135*f* may be fixedly attached to bearing connector 130*f* by moving slat along the direction of the dashed line. Slat 120*g* is omitted for clarity.

Figure 3A:
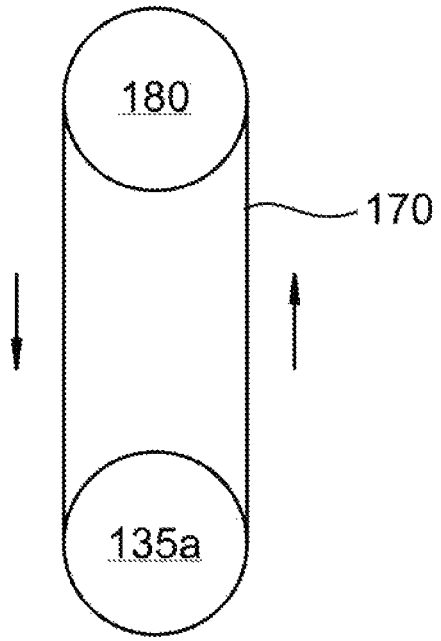
FIG. 3A illustrates an embodiment of the second drive belt as it interacts with the second horizontal shaft in the headrail and a top bearing.

FIG. 3A shows a close-up view of second drive belt 170 around second horizontal shaft 180 and bearing 135*a*. Second horizontal shaft 180 may rotate second drive belt 170 such that bearing 135*a* may also be rotated.

Figure 3B:
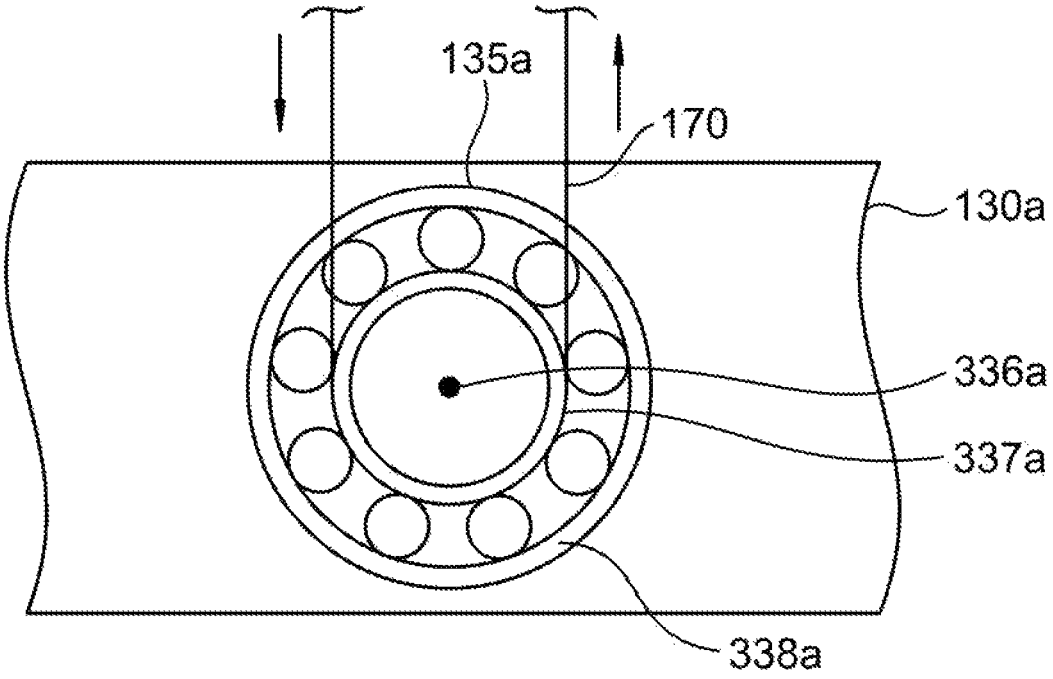
FIG. 3B shows a close-up view of an embodiment of a top bearing in a top bearing connector where the top bearing is a ball bearing.

FIG. 3B shows a detailed view of top bearing 135*a* as it may be connected to bearing connector 130*a*. Outer race 338*a* of top bearing 135*a* may be fixedly attached to bearing connector 130*a*. Inner race 337*a* may protrude from the face of top bearing 135*a* such that second drive belt 170 may wrap around inner race 337*a*. Peg 336*a* may be fixedly attached to the center of inner race 337*a* and a slat. This may allow drive belt 170 to rotate inner race 337*a* such that a slat attached to top bearing 135*a* may also tilt accordingly.

Figure 4A:
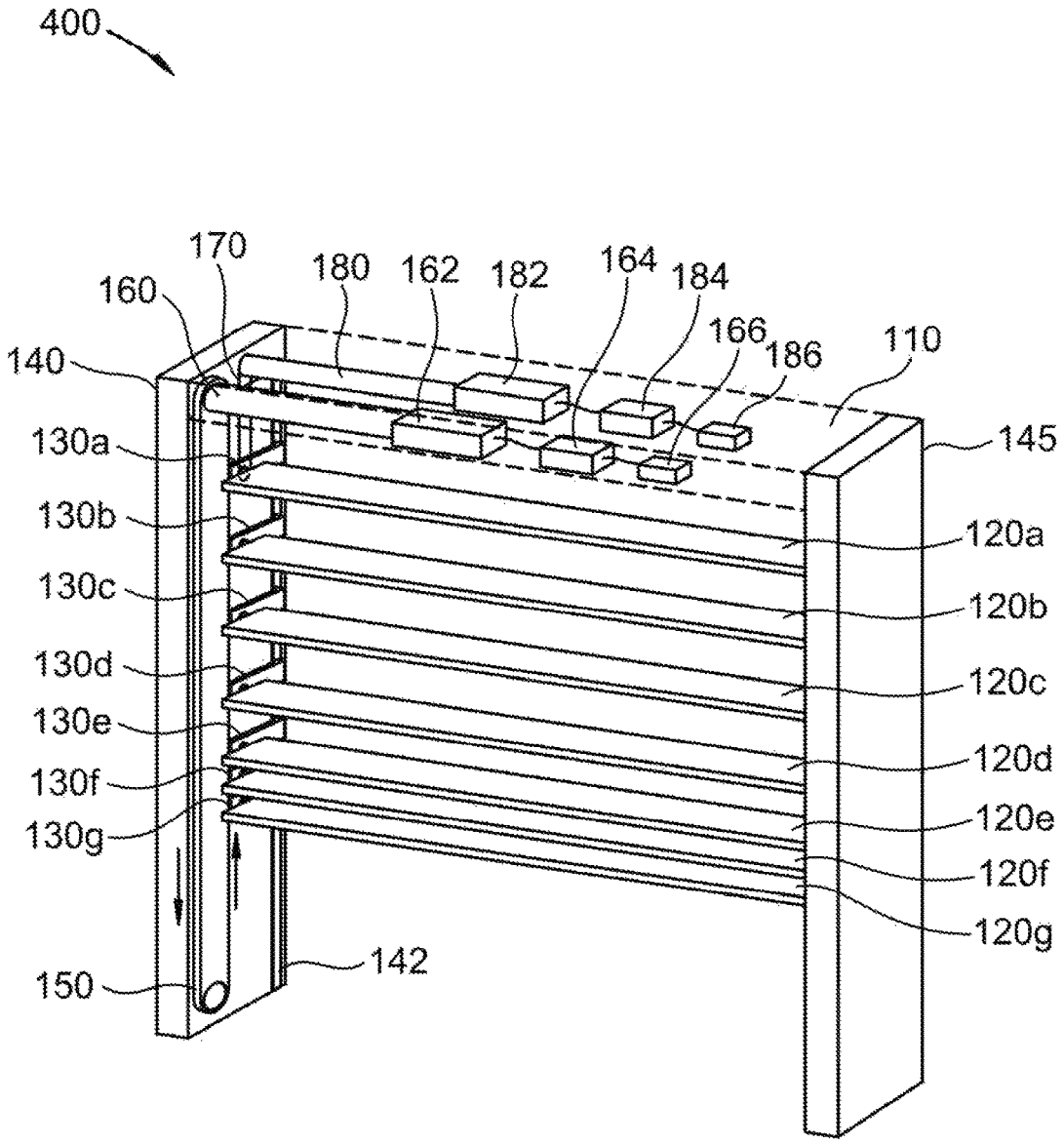
FIG. 4A shows the window blind of FIG. 1A with the bottom slats of the window blind in the process of raising.

FIG. 4A shows window blind 400, which is a configuration of window blind 100 which shows slats 120*e*-120*g* as they may appear in the process of raising. As first drive belt 150 rotates counter-clockwise, bottom bearing connector 130*g* may move upward as it interfaces with first drive belt 150. When bottom bearing connector 130*g* reaches bearing connector 130*f*, bottom bearing connector 130*g* raises bearing connector 130*f* as well and so on until slats 120*a*-120*g* have all been raised.

Figure 4B:
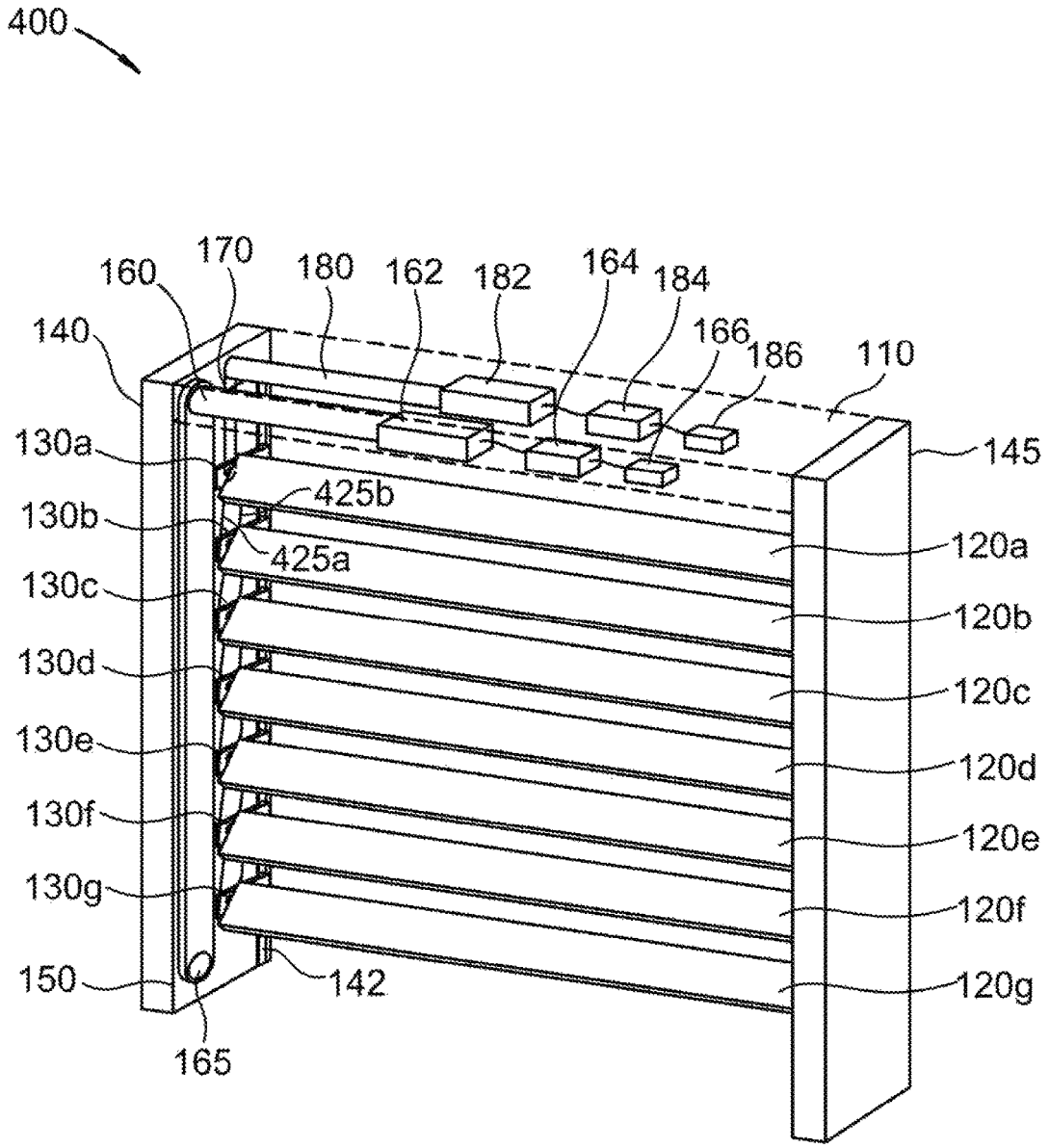
FIG. 4B shows the window blind of FIG. 1A with the slats tilted.

FIG. 4B shows window blind 400 in another configuration of window blind 100 in which the slats are tilted. In this configuration, second horizontal shaft 180 has rotated such that drive belt 170 has also rotated slat 120*a* as described herein. Strings 425*a* and 425*b* are also shown to illustrate how slats 120*b*-120*g* tilt as slat 120*a* tilts.

Figure 5:
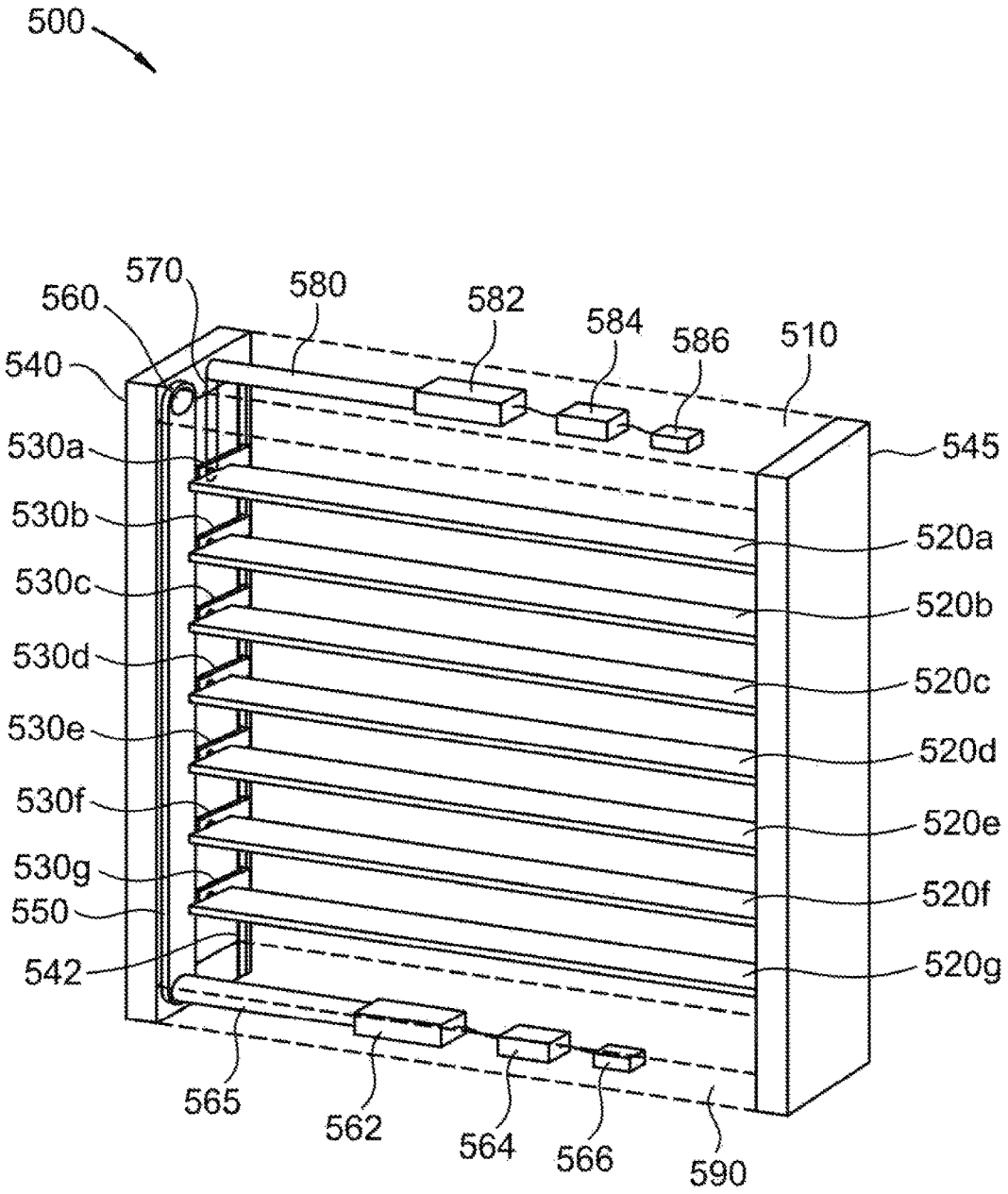
FIG. 5 illustrates an overall perspective view of an embodiment of a cordless window covering system to the disclosure in which a horizontal shaft which operates a drive belt that raises and lowers the slats is contained in a bottom rail.

FIG. 5 illustrates window blind 500 which is an embodiment of the disclosed cordless window covering system. Window blind 500 includes headrail 510 and a frame which includes vertical sides 540 and 545. In this embodiment, bottom rail 590 includes first horizontal shaft 565, which may rotate first drive belt 550 around third horizontal shaft 560, where third horizontal shaft 560 is contained in headrail 510. First horizontal shaft 565 may be actuated by motor 562, which may be connected to battery 564. Battery 564 may power motor 562 when motor controller 566 receives a signal from a user to remotely operate window blind 500. Headrail 510 also includes second horizontal shaft 580, which may rotate second drive belt 570. Second horizontal shaft 580 may be actuated by motor 582, which may be connected to battery 584. Battery 584 may power motor 582 when motor controller 586 receives a signal from a user to remotely operate window blind 500. Window blind 500 also includes slats 520*a*-520*g*. Slats 520*a*-520*g* may each be attached to bearing connectors 530*a*-530*g*, respectively. Bearing connectors 530*a*-530*g* may each slide vertically along guide channel 542. The drive belt, bearing connectors, and horizontal shaft of vertical side 545 are omitted in this figure for clarity.

While specific embodiments have been illustrated and described above, it is to be understood that the disclosure provided is not limited to the precise configuration, steps, and components disclosed. Various modifications, changes, and variations apparent to those of skill in the art may be made in the arrangement, operation, and details of the methods and systems disclosed, with the aid of the present disclosure.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art that changes may be made to the details of the above-described embodiments without departing from the underlying principles of the disclosure herein.

We claim:

1. A cordless window covering system comprising:

a frame, wherein the frame encloses plurality of slats, each of the plurality of slats comprising:
- a first and a second lateral side; and
- a peg extending from each of the first and the second lateral sides, wherein at least one string connects the plurality of slats, and wherein the frame comprises:
  - a headrail, the headrail comprising:
    - a first and a second motor; and
    - a first and a third horizontal shaft;
  - a bottom rail, the bottom rail comprising a second horizontal shaft;
  - two vertical side rails, each of the vertical side rails comprising:
    - a guide channel;
    - a plurality of bearing connectors, wherein each of the plurality of bearing connectors is slidably connected to the guide channel;
    - a plurality of bearings, each within one of the plurality of bearing connectors, wherein each peg inserts into one of the plurality of bearings; and
    - a first drive belt disposed between the first and the third horizontal shafts.

2. The cordless window covering system of claim 1, further comprising a bottom bearing connector, wherein the bottom bearing connector interfaces with the first drive belt.

3. The cordless window covering system of claim 2, wherein the bottom bearing connector interfaces with the first drive belt by interfacing with one or more of a plurality of grooves connected to the first drive belt.

4. The cordless window covering system of claim 2, wherein the bottom bearing connector is fixedly attached to the first drive belt.

5. The cordless window covering system of claim 1, further comprising a first motor controller, wherein the first motor controller actuates the first motor causing the first drive belt to rotate around the first and third horizontal shafts, thereby applying vertical force to the bearing connectors and, thereby causing the blind slats to raise and lower.

6. The cordless window covering system of claim 1, further comprising a top bearing, and a second drive belt, wherein the second drive belt interfaces with top bearing and the second horizontal shaft.

7. The cordless window covering system of claim 6, further comprising a second motor controller, wherein the second motor controller actuates the second motor causing the second drive belt to rotate around the second horizontal shaft and the top bearing, thereby causing the slats to tilt.

8. The cordless window covering system of claim 1, wherein each of the plurality of bearings consists of either a ball bearing or a needle bearing.

9. The cordless window covering system of claim 1, wherein the at least one string connecting the plurality of slats consists of two strings.

10. The cordless window covering system of claim 9, wherein one of the two strings is connected to each of the first and the second lateral sides of the slats.

11. A cordless window covering system comprising:

a frame, wherein the frame encloses plurality of slats, each of the plurality of slats comprising:

a first and a second lateral side; and a peg extending from each of the first and the second lateral sides, wherein at least one string connects the plurality of slats, and wherein the frame comprises:

a bottom rail, the bottom rail comprising:

a first motor; and a first and a third horizontal shaft, wherein the first motor is connected to the first horizontal shaft;

a headrail, the headrail comprising:

a second motor; and a second horizontal shaft, wherein the second motor is connected to the second horizontal shaft;

two vertical side rails, each of the vertical side rails comprising:

a guide channel;

a plurality of bearing connectors, wherein each of the plurality of bearing connectors is slidably connected to the guide channel;

a plurality of bearings, wherein each peg inserts into one of the plurality of bearings, and wherein each of the plurality of bearings is within one of the plurality of bearing connectors; and a first drive belt disposed between the first and the third horizontal shafts.

12. The cordless window covering system of claim 11, further comprising a bottom bearing connector, wherein the bottom bearing connector interfaces with the first drive belt.

13. The cordless window covering system of claim 12, wherein the bottom bearing connector interfaces with the first drive belt by interfacing with one or more of a plurality of grooves connected to the first drive belt.

14. The cordless window covering system of claim 12, wherein the bottom bearing connector is fixedly attached to the first drive belt.

15. The cordless window covering system of claim 11, further comprising a first motor controller, wherein the first motor controller actuates the first motor causing the first drive belt to rotate around the first and third horizontal shafts, thereby applying vertical force to the bearing connectors and, thereby causing the blind slats to raise and lower.

16. The cordless window covering system of claim 11, further comprising a top bearing, further comprising a top bearing, and a second drive belt, wherein the second drive belt interfaces with top bearing and the second horizontal shaft.

17. The cordless window covering system of claim 16, further comprising a second motor controller, wherein the second motor controller actuates the second motor causing the second drive belt to rotate around the second horizontal shaft and the top bearing, thereby causing the slats to tilt.

18. The cordless window covering system of claim 11, wherein each of the plurality of bearings consists of either a ball bearing or a needle bearing.

19. The cordless window covering system of claim 11, wherein the at least one string connecting the plurality of slats consists of two strings.

20. The cordless window covering system of claim 19, wherein one of the two strings is connected to each of the first and the second lateral sides of the slats.

* * * * *